US005295533A

United States Patent [19]

Ueno

[11] Patent Number: 5,295,533

[45] Date of Patent: Mar. 22, 1994

[54] HEAT EXCHANGER

[75] Inventor: Yasuo Ueno, Kawasaki, Japan

[73] Assignee: Kokusai Gijutsu Kaihatsu Kabushiki Kaisha, Tokyo, Japan

[21] Appl. No.: 857,228

[22] Filed: Mar. 25, 1992

[30] Foreign Application Priority Data

Mar. 29, 1991 [JP] Japan ..... 3-092775
Jun. 24, 1991 [JP] Japan ..... 3-178804

[51] Int. Cl.[5] ..... F28F 5/00

[52] U.S. Cl. ..... 165/88; 165/86; 165/92; 165/911; 62/121; 62/304

[58] Field of Search ..... 165/86, 88, 92

[56] References Cited

U.S. PATENT DOCUMENTS 2,980,403 4/1961 Ahlen ..... 165/86
4,044,824 8/1977 Eskeli ..... 165/88

FOREIGN PATENT DOCUMENTS 34165 3/1979 Japan ..... 165/92

*Primary Examiner*—Albert W. Davis, Jr.
*Attorney, Agent, or Firm*—James C. Wray

[57] ABSTRACT

A heat exchanger for exchanging heat between a first fluid and a second fluid comprises a moving partition member for heat transmission between the first fluid and the second fluid, a housing partitioned by the moving partition member into a first chamber for passing the first fluid and a second chamber for passing the second fluid, and a power source for rotating the moving partition member.

6 Claims, 8 Drawing Sheets

HEAT EXCHANGER

BACKGROUND OF THE INVENTION

1. Field of the Invention

This invention relates to a heat exchanger able to exchange heat between two fluids with extremely high efficiency.

2. Description of the Prior Art

In homes, offices, factories and the like, it is frequently found necessary to exchange heat between two fluids. For example, heat exchange is required between indoor and outdoor air during ventilation of air-conditioned rooms, between the intake and exhaust air of hot air driers, between supply water and waste water at factories and in many other situations.

The methods conventionally used for such heat exchange between two fluids, specifically between two gases, between two liquids or between a gas and a liquid, include the so-called radiator method in which a liquid is pumped through a long, winding pipe provided with many fins and a gas is blown onto it with a fan, the method in which two fluids are passed through alternate passages of a honeycomb structure made of thin sheet metal, and the method in which heat exchange is achieved through the medium of a rotating heat-absorbing body which is alternately inserted into two flow paths.

Each method has its disadvantages. The first requires a complex and expensive heat exchanger, the second achieves low heat exchange for its size owing to the use of immovable fins, and the third leads to some degree of mixing of the two fluids between which heat exchange is conducted. While in all three methods the temperature difference between the two fluids is smaller after heat exchange than before, in none of them does the high-low temperature relationship between the two fluids reverse. Defining the heat exchange efficiency in the case where the temperatures of two heat-exchanged fluids reverse as 100 (%), heat exchange efficiency by the conventional methods never exceeds 50 (%).

SUMMARY OF THE INVENTION

One object of the invention is to provide a compact, high-performance heat exchanger capable of high-efficiency heat exchange.

Another object of the invention is to provide a heat exchanger in which heat transmission through a partition member provided between two fluids subject to heat exchange is markedly promoted.

Another object of the invention is to provide a heat exchanger in which the heat exchange efficiency is improved by increasing the temperature difference between two fluids subject to heat exchange.

Another object of the invention is to provide a heat exchanger enabling the temperature difference between two fluids subject to heat exchange present on opposite sides of a partition member to be effectively maintained.

Another object of the invention is to provide a heat exchanger suitable for achieving cooling capability in air conditioning.

For achieving these purposes, the present invention provides a heat exchanger for exchanging heat between a first fluid and a second fluid which comprises a housing formed with a moving partition member for transmitting heat between the first fluid and the second fluid, a first chamber partitioned off by the partition member through which the first fluid flows in a first direction and a second chamber through which the second fluid flows in substantially an opposite direction from the first direction, and a power source for rotating the partition member. The rotation of the partition member by the power source results in a high relative velocity between the surfaces of the partition member and the respective fluids and since thermal conductivity increases in proportion to the relative velocity, heat exchanges efficiently between the two fluids. Moreover, since the first and second fluids flow in substantially opposite directions, approximately the same temperature difference is maintained over the whole distance that they flow past each other. Under this condition, if the rotational speed of the partition is increased so as to boost the thermal conductivity, it is possible to obtain a heat exchange efficiency exceeding the aforesaid 50% and even to realize one as high as 70% or more.

Moreover, in a case where one of the fluids is a gas, the centrifugal force produced by the rotation of the partition member adiabatically compresses the gas and thus increases its temperature. This increased temperature can be transferred to the other, low-temperature fluid. When the gas is discharged after its temperature has fallen, it expands owing to the decrease in pressure at this time, so that its temperature falls even further.

As a result, it becomes possible to lower the temperature of the gas at the time it is discharged to that of the low-temperature fluid or even lower, while at the same time raising the temperature of the low-temperature fluid at the time of discharge to or above that of the high-temperature fluid (i.e. the gas).

In another of its aspects, the present invention provides a heat exchanger in which heat is exchanged between a fluid and a humidified gas using the heat of vaporization. This heat exchanger comprises a housing formed with a moving partition member for transmitting heat between the fluid and the gas, a first chamber partitioned off by the partition member through which the fluid flows in a prescribed first direction and a second chamber through which the gas flows in substantially the same direction as the first direction, a humidification means provided for humidifying the gas in the second chamber, and a power source for rotating the partition member. The temperature of the gas is lowered by the loss of heat of vaporization upon vaporization of the moisture content of the humidified gas, whereby the temperature difference between the fluid and the gas increases. The thermal conductivity between the gas and the fluid increases in proportion to the relative velocity between themselves and the moving partition member resulting from the rotation of the moving partition member, whereby highly efficient heat exchange between the gas and the fluid can be achieved. The fluid can be either a gas or a liquid. Since the fluid and the gas flow through the first and second chambers in the housing in substantially the same direction, the temperature difference between them can be maintained substantially constant along the flow paths of the respective chambers, so that efficient heat exchange can be achieved.

This invention will be better understood and other objects and advantages thereof will be more apparent from the following detailed description of preferred embodiments with reference to the accompanying drawings.

DESCRIPTION OF THE PREFERRED EMBODIMENTS

Figure 1:
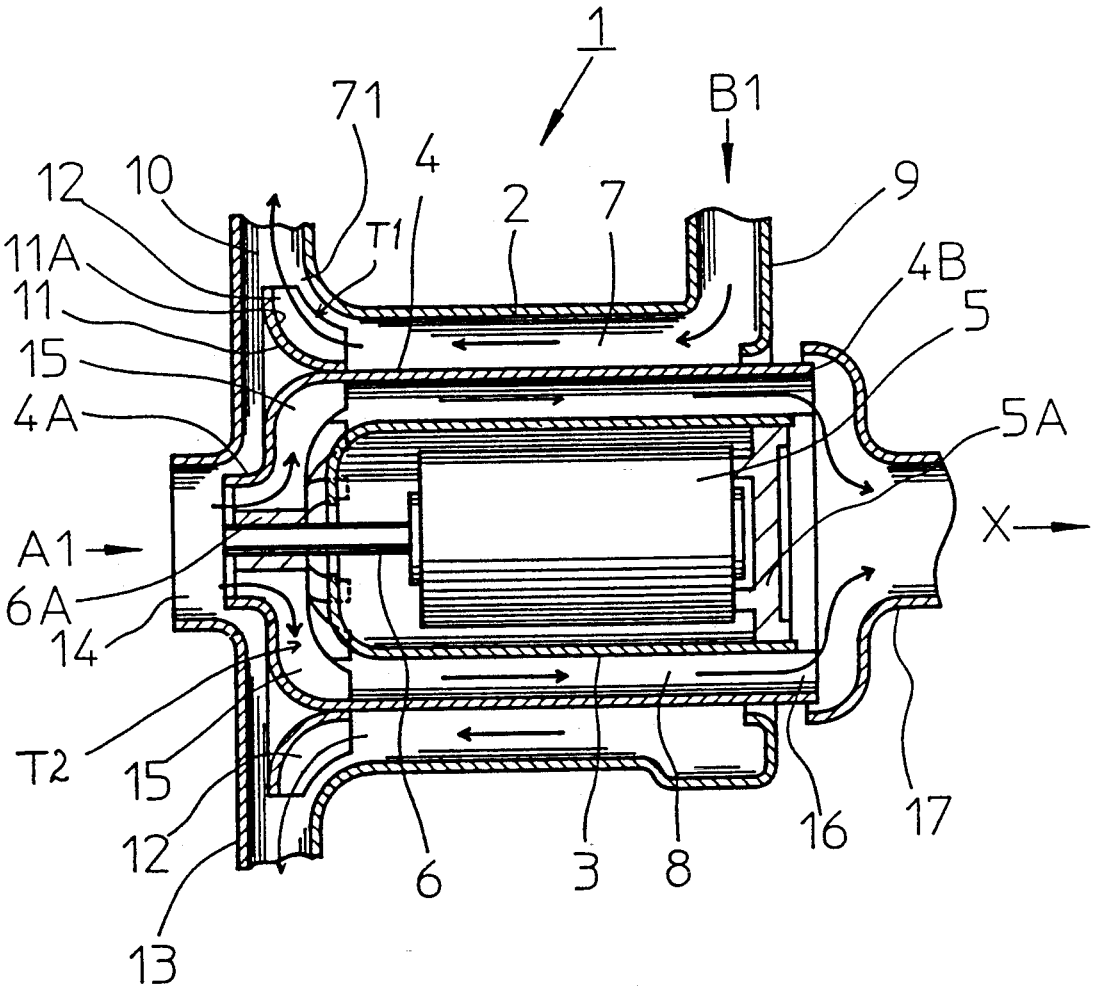
FIG. 1 is a sectional view of an embodiment of the heat exchanger according to the invention.

FIG. 1 shows a cross-section of an embodiment of the heat exchanger according to the invention. This embodiment, designated by reference numeral 1 in FIG. 1, is used for heat exchange between warm air A1 being exhausted to the outside from a heated room and cold, fresh air B1 being drawn into the room from outdoors. The aim is to raise the temperature of the air B1 closer to that of the air A1 before blowing it into the room.

The heat exchanger 1 has a fixed outer cylinder member 2 and a fixed inner cylinder member 3 disposed concentrically therein, both of which are made of a heat insulating material and fixed to a frame (not shown) by appropriate means. Between the fixed outer cylinder member 2 and the fixed inner cylinder member 3 is disposed a moving partition member 4 which is made of high thermal conductivity aluminum or equivalent and has a generally cylindrical shape. One end 4A of the moving partition member 4 is fixed, in a manner that will be explained later, so as to be aligned with the output shaft 6 of a motor 5 fixed to a bracket 5A inside the fixed inner cylinder member 3. The space between the fixed outer cylinder member 2 and the fixed inner cylinder member 3 is thus partitioned by the moving partition member 4 into annular first and second chambers 7 and 8.

An intake duct 9 communicating with the outside opens into one end of the first chamber 7 and a curved member 11 for constituting a centrifugal turbine T1 is provided at the annular opening at the other end thereof. The curved member 11 is fixed to the outer periphery of the moving partition member 4 by spot welding or other appropriate means. The curved member 11 curves parallel to the fixed outer cylinder member 2 and is provided on the inner surface 11*a* thereof with a large number of radially extending fins 12 spaced regularly in the circumferential direction. The fins 12 collectively form the centrifugal turbine T1.

Thus when moving partition member 4 is rotated in a prescribed direction by the motor 5, the centrifugal turbine T1 draws outdoor air B1 into the first chamber 7 through the intake duct 9 and discharges it though an exhaust port 10 formed near the centrifugal turbine T1. The centrifugal turbine T1 is designed so that the air drawn in through the intake duct 9 will pass through first chamber 7 at a relatively low speed. The outdoor air B1 discharged from the exhaust port 10 is conducted into the room via a duct not shown in the figure.

The outermost member of the heat exchanger 1 is a housing 13, which is formed with an intake port 14 facing the one end 4A of the moving partition member 4. The inner surface of the one end 4A is provided with a large number of fins 15 spaced at intervals in its circumferential direction. The fins 15 constitute a centrifugal turbine T2 which, when the moving partition member 4 is rotated, draws indoor air A1 through the intake port 14 and sends it into the second chamber 8, from which it is discharged from an exhaust port 16 of the second chamber 8. The tips of the fins 12 are fixed to a sleeve 6A fixed on the output shaft 6, whereby the moving partition member 4 is fixed to the output shaft 6. An exhaust duct 17 disposed opposite the exhaust port 16 conducts the air discharged through the exhaust port 16 to the outside.

The operation of the heat exchanger 1 will now be explained with reference to FIGS. 1 and 2. When the moving partition member 4 is rotated by the motor 5, indoor air A1 near the intake port 14 is sent into the second chamber 8 by the centrifugal turbine T2. Of the indoor air A1 entering the second chamber 8, that part situated near the moving partition member 4 moves in the circumferential direction owing to the rotation of the moving partition member 4, while that part near the fixed inner cylinder member 3 is not exposed to a circumferential force and therefore does not circulate circumferentially. As a result, the indoor air A1 in the second chamber 8 circulates with a large velocity gradient in the radial direction. It is a principle of physics that, in such a case, the thermal conductivity Ac between the high-temperature fluid (i.e. the indoor air A1) and the moving partition member 4 increases in proportion to the $\alpha$th power (the value of $\alpha$ being around 0.7–0.8) of the relative velocity between them. Therefore, if, for example, the moving partition member 4 rotates at 20 revolutions per second (rps), the indoor air A1 rotates at 10 rps and $\alpha=0.75$, the heat transmission will be about 5.6 times that in the case where the moving partition member 4 does not rotate.

On the other hand, centrifugal turbine T1 constituted by the fins 12 draws the low-temperature fluid (i.e. the outdoor air B1) into the first chamber 7 through the intake duct 9 and discharges it into the room though the exhaust port 10. In this case too, the amount of heat transferred from the moving partition member 4 to the outdoor air B1 in the first chamber 7 increases in proportion to the 0.7–0.8th power of the relative velocity between them. Thus, by rotating the moving partition member 4, it is possible to markedly promote the heat transmission for heat exchange at the moving partition member 4.

The indoor air A1, the high-temperature fluid, decreases in temperature as it passes through the second chamber 8 from left to right in FIG. 1, while the outdoor air B1, the low-temperature fluid, increases in temperature as it passes from right to left in the same figure.

Figure 2:
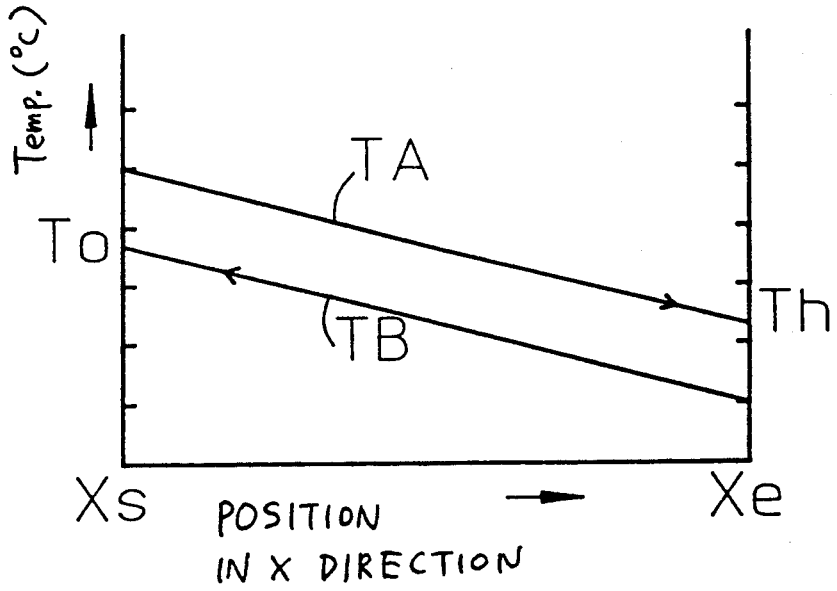
FIG. 2 is a graph showing temperature variation inside the heat exchanger of FIG. 1.

These changes in the temperature of indoor air A1 and the outdoor air B1 are shown in FIG. 2, in which the symbol X indicates the position in the X direction in FIG. 1, Xs indicates the position of the one end 4A of the moving partition member 4 and Xe indicates the position of the other end 4B thereof. The symbol TA denotes the temperature variation curve of the air A1 and TB that of the air B1. As can be seen in FIG. 2, the temperature difference between the air A1 and the air B1 is approximately constant in the X direction, so that heat constantly flows from the air A1 to the air B1 throughout the passage of the two fluids A1 and B1 through the chambers 8 and 7. As a result, the temperature To of the air B1 at Xs is higher than the temperature Th of the air A1 at Xe, meaning that the heat exchanger 1 is able to conduct heat exchanges which reverses the high-low temperature relationship between the two fluids A1 and B1.

The value of Th - To depends on numerous factors including the aforesaid thermal conductivity Ac, the diameter of the moving partition member 4, the distances between the moving partition member 4 and the fixed inner cylinder member 3 and between the moving partition member 4 and the fixed outer cylinder member 2, and the speeds of the air A1 and the air B1 in the axial direction of the heat exchanger 1. However, the fact that for any given set of parameters the difference can be decreased in proportion to the 0.7–0.8th power of the relative velocity established by rotating the moving partition member 4 points up the very great importance of the rotating motion in this kind of heat exchanger.

While the embodiment shown in FIG. 1 is provided with the fins 12 and the fins 15 for constituting centrifugal turbines at one end of the moving partition member 4, it will be understood that it is of course possible instead to use any of various other appropriate means for providing the power needed for driving the air A1 and the air B1.

Figure 3:
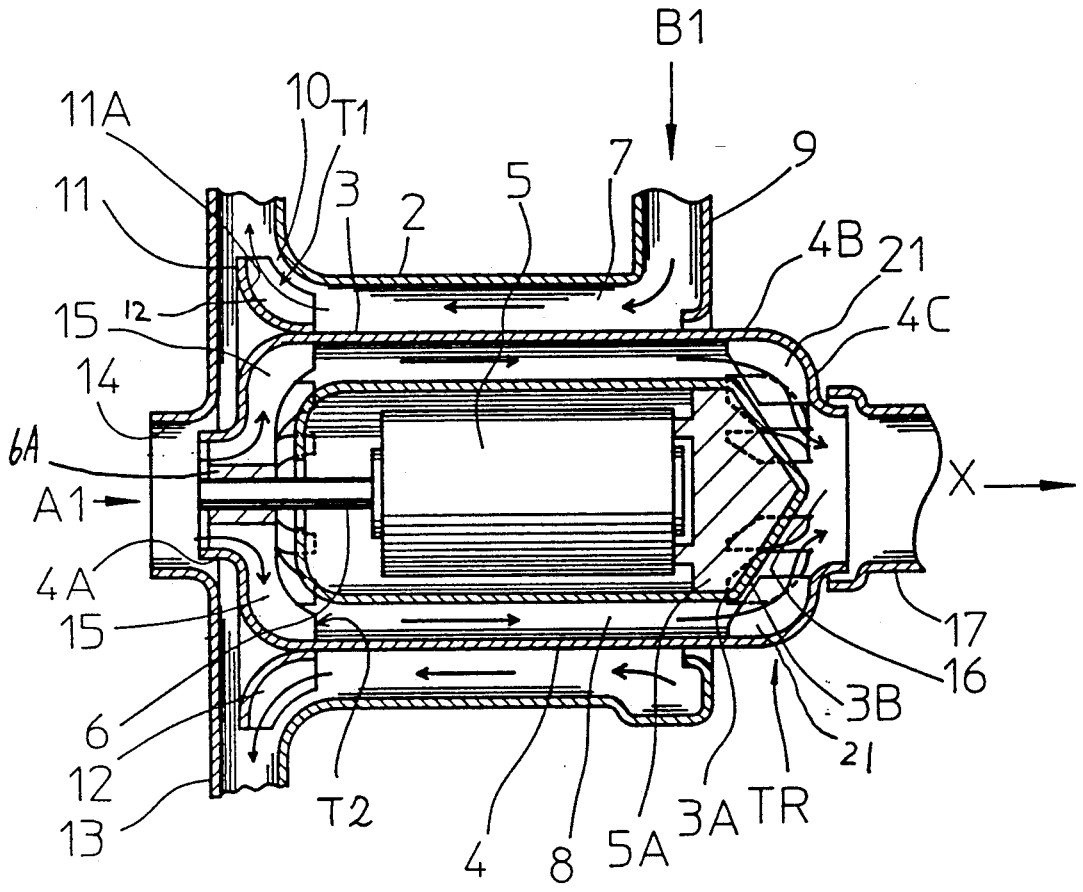
FIG. 3 is a sectional view of another embodiment of the heat exchanger according to the invention.

Another embodiment of the heat exchanger according to the invention is illustrated in FIG. 3. This second embodiment, indicated by reference numeral 20 in FIG. 3, is basically the same as the heat exchanger 1 shown in FIG. 1. However, it differs from the heat exchanger 1 of FIG. 1 in that the end 3A of its fixed inner cylinder member 3 is further provided with a conical cover 3B which closes the opening of the fixed inner cylinder member 3 at the end 3A thereof, and that the other end 4B of the moving partition member 4 is provided with an extension 4C which curves radially inward to reduce its diameter and which is provided on its inner surface with a large number of appropriately spaced fins 21 for constituting a centrifugal turbine TR for exerting a force on the fluid at the outlet end of the second chamber 8 tending to inhibit its flow out of the second chamber 8. The constituent elements of the embodiment of FIG. 3 corresponding to those of the embodiment of FIG. 1 are assigned identical reference numbers to those in FIG. 1 and will not be explained further here.

As can be seen in FIG. 3, the diameter D1 of the opening at the one end 4A of the moving partition member 4 is smaller than the diameter D2 of the opening at the other end 4B thereof, so that the thrust of the centrifugal turbine T2 is somewhat larger than that of the centrifugal turbine TR. As a result, the air A1 charged into the second chamber 8 by the centrifugal turbine T2 meets a high resistance produced by the centrifugal turbine TR at the discharge end, whereby the pressure in the second chamber 8 is increased.

Figure 4:
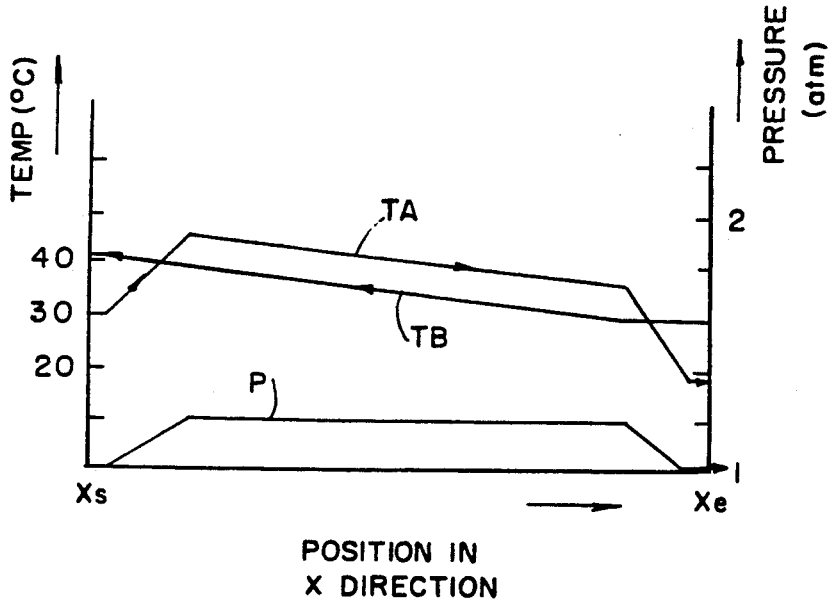
FIG. 4 is a graph showing pressure and temperature variation inside the heat exchanger shown in FIG. 3.

As can be seen from the graph of FIG. 4 showing an example of the pressure variation in the X direction of the second chamber 8, the pressure P in the second chamber 8 rises to a certain level. Since this pressure increases adiabatically, the temperature of the air A1 rises. Since the rise in its absolute temperature is proportional to the 0.28th power of the pressure increase, in the case where, for example, the pressure of 30° C. air is increased 0.2 atm, the temperature rises about 16° C.

This temperature rise has the effect of further heating the outdoor air B1. In addition, when the compressed air A1 is discharged from the second chamber 8, it undergoes adiabatic expansion and the temperature decreases this causes lowers the temperature of the air A1 itself. Thus by increasing the temperature change obtained by the adiabatic compression and expansion, it becomes possible to realize a heat exchange efficiency exceeding 100%. This means that under appropriately selected conditions, the heat exchanger 20 can operate as a room cooler.

This operating state is shown in FIG. 4, in which TA and TB are curves showing the temperature variation of air A1 and air B1 in the case where the air A1 undergoes adiabatic compression as indicated by the curve P.

FIG. 4 relates to a case in which the air A1 and air B1 both have a temperature of 30° C. In this example, the increased pressure of the air A1 causes its temperature to rise to 46° C. Heat exchange is carried out in this state, raising the temperature TB of the air B1 to 41° C. and lowering the temperature TA of the air A1 to 35° C. The air A1 thereafter expands adiabatically owing to the reduction in pressure when it is discharged from the second chamber 8 and, as a result, its temperature falls to 19° C.

In this example, air A1 and air B1, both initially having a temperature of 30° C., are converted into air A1 and air B1 having temperatures of 41° C. and 19° C., respectively. The 19° C. air can be used for cooling a room. (In this case, B1 has to be indoor air and A1 outdoor air.)

Figure 5:
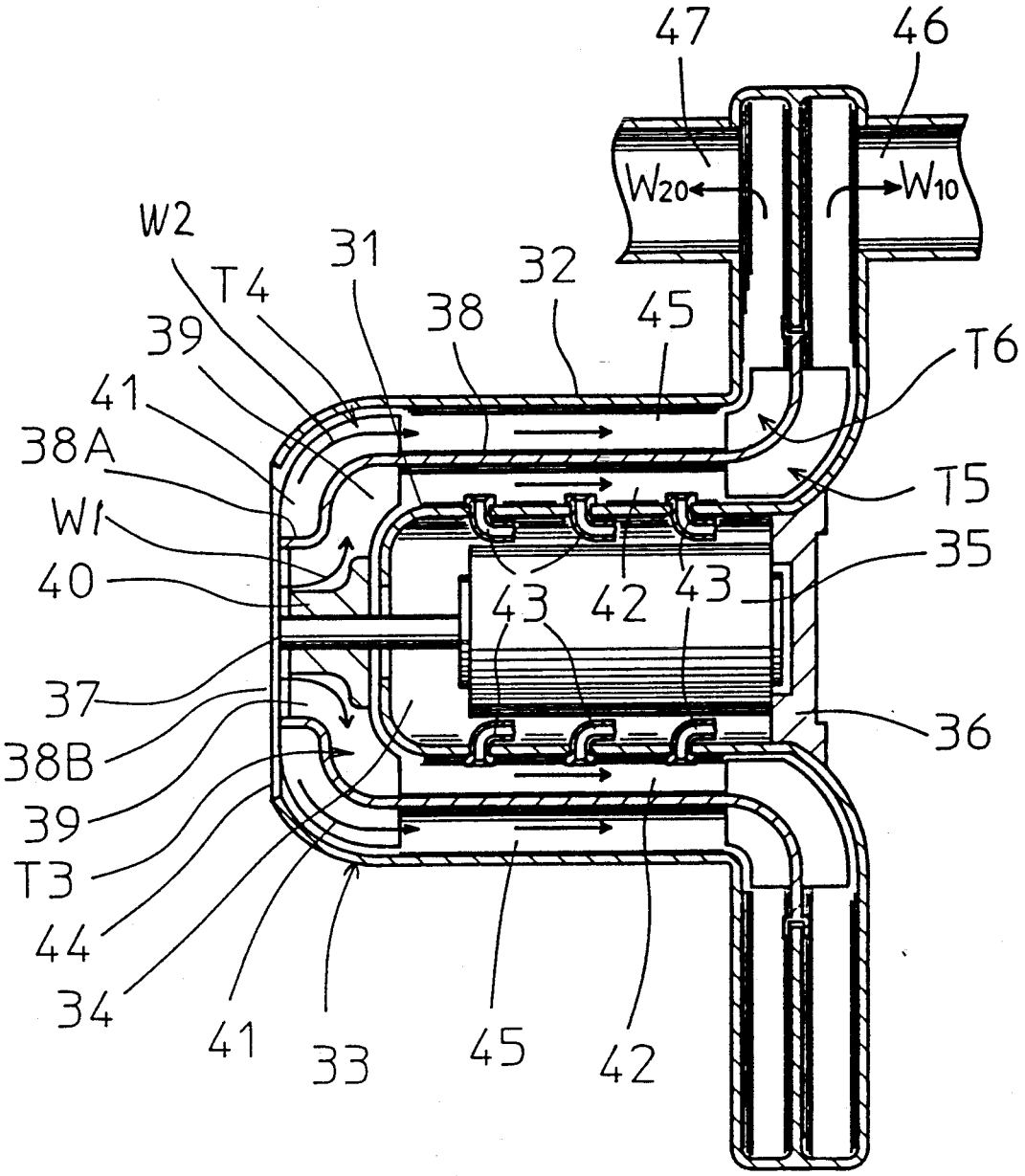
FIG. 5 is a sectional view of another embodiment of the heat exchanger according to the invention.

FIG. 5 shows another embodiment of the invention. The heat exchanger 30 of this embodiment is designed to have heat exchange characteristics that are particularly advantageous for achieving cooling capability. While its structure is basically the same as that of the heat exchanger 1 shown in FIG. 1, it differs therefrom in that the fluids subject to heat exchange flow in the same direction and that it is equipped with humidifying means for imparting humidity to one of the fluids.

The structure of the heat exchanger 30 will now be explained with reference to FIG. 5. The heat exchanger 30 has a housing 33 made of a low thermal conductivity material and having an inner cylinder member 31 and an outer cylinder member 32. A motor 35 is disposed in the space enclosed by the inner cylinder member 31. The motor 35 is fixed to the housing 33 via a bracket 36 so that its output shaft 37 is aligned with the axes of the inner cylinder member 31 and the outer cylinder member 32.

A moving partition member 38 fabricated in cylindrical shape from thin aluminum sheet material is disposed approximately equidistant between the inner cylinder member 31 and the outer cylinder member 32. One end of the moving partition member 38 is curved radially inward to form a curved portion 38A of reduced diameter. The inner surface of the curved portion 38A is provided with a large number of upright fins 39 extending toward the axis of the moving partition member 38, thus constituting a centrifugal turbine T3. The tips of the fins 39 are fixed to a sleeve 40 fixed on the output shaft 37 of the motor 35. As a result, the moving partition member 38 is fixed to the output shaft 37 so as to rotate about the axis of the output shaft 37 when it is rotated by the motor 35. The outer surface of the curved portion 38A is provided with a large number of radially extending fins 41, thus constituting a centrifugal turbine T4.

Outside air W1 is conducted into an opening 38B at the end of the moving partition member 38 through a duct that is not shown in the figure. When rotated by the motor 35, the centrifugal turbine T3 forces outside air W1 into a humidification chamber 42 formed between the moving partition member 38 and the inner cylinder member 31. The inner cylinder member 31 is provided with a large number of spray nozzles 43 supplied with water by a pump not shown in the figure. The outside air W1 is humidified by the water sprayed from these nozzles.

Since the outside air W1 sent into the humidification chamber 42 receives rotating force from the moving partition member 38, it swirls as it advances through the humidification chamber 42 and, while doing so, absorbs the moisture supplied through the spray nozzles 43. Owing to the heat of vaporization lost during this process, the temperature of the air in the humidification chamber 42 decreases gradually as it proceeds toward the outlet.

An annular opening 44 formed between the moving partition member 38 and the outer cylinder member 32 communicates with a duct not shown in the figure. The centrifugal turbine T4 draws in indoor air W2 through this duct and sends it through the annular opening 44 into a cooling chamber 45 formed between the moving partition member 38 and the outer cylinder member 32. The indoor air W2 forced into the cooling chamber 45 also swirls as it advances toward the outlet.

The outlets of the humidification chamber 42 and the cooling chamber 45 are formed with centrifugal turbines T5 and T6, similar to the centrifugal turbines T3 and T4 explained above. The centrifugal turbines T5 and T6 discharge air from the chambers 42 and 45 into associated ducts 46 and 47. The turbines T5 and T6 are, however, not absolutely necessary and can be omitted if convenient.

In the foregoing arrangement, outside air W1 charged into the humidification chamber 42 is lowered in temperature utilizing the heat of vaporization, thus converting it into cold air, and the indoor air W2 forced into the cooling chamber 45 is efficiently cooled via the moving partition member 38 as it rotates. The principle involved is the same as that explained earlier in connection with the heat exchanger 1 of FIG. 1. The air W10 humidified in the humidification chamber 42 is discharged to the outside through the duct 46, while the air W20 cooled in the cooling chamber 45 is returned to the room through the duct 47. As a result, the room can be effectively cooled utilizing the heat of vaporization.

Where the outside air W1 has a temperature of 35° C. and a relative humidity of 50% prior to heat exchange, for example, it can, by using heat of vaporization, be converted into air having a temperature of 25° C. and a relative humidity of 100%. In this case, the specific humidity of the outside air W1 increases 0.3%, causing it to lose heat at the rate of 1.8 Kcal per kg. Under these conditions, the temperature of the indoor air W2 falls about 8° C. to 22° C. Although its relative humidity increases as its temperature falls, its specific humidity remains unchanged since no moisture is added to it. It therefore does not increase the discomfort index of the room being cooled or lead to dew condensation.

Figure 6:
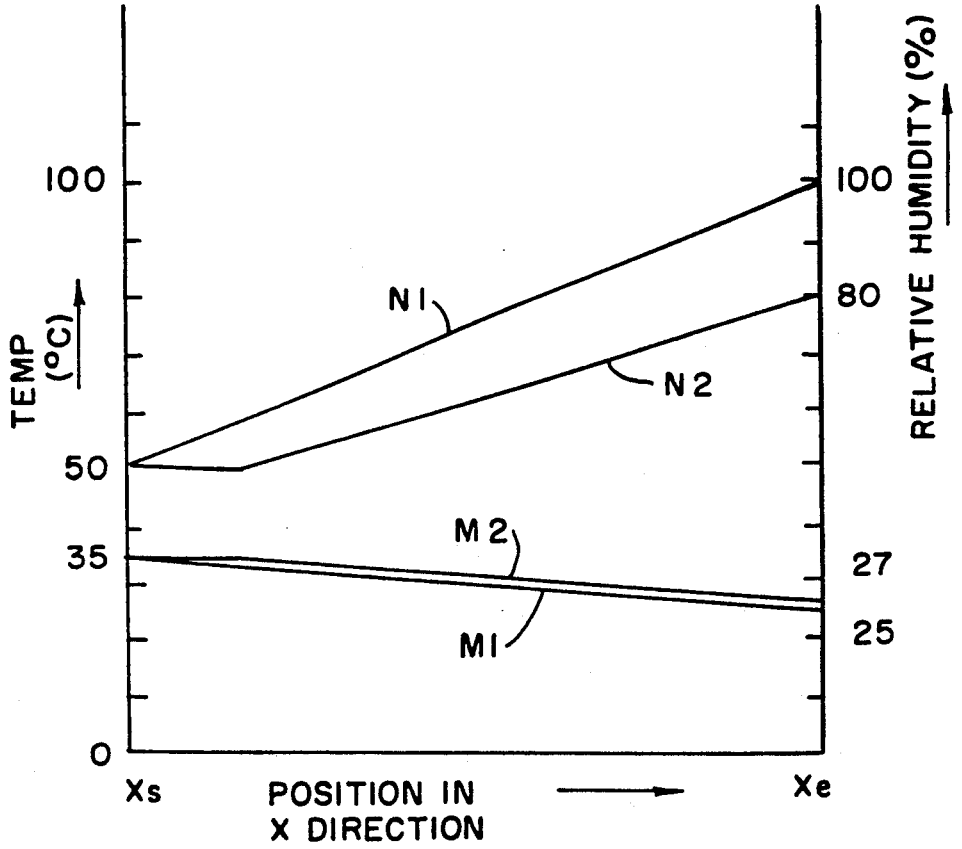
FIG. 6 is a graph showing temperature and humidity variation in the heat exchanger shown in FIG. 5.

These heat exchange effects are illustrated in FIG. 6, in which positions in the X direction are plotted on the horizontal axis, M1 and M2 are curves showing the temperature variation of the outside air W1 and the indoor air W2, and N1 and N2 are curves showing their relative humidity variation.

Figure 7:
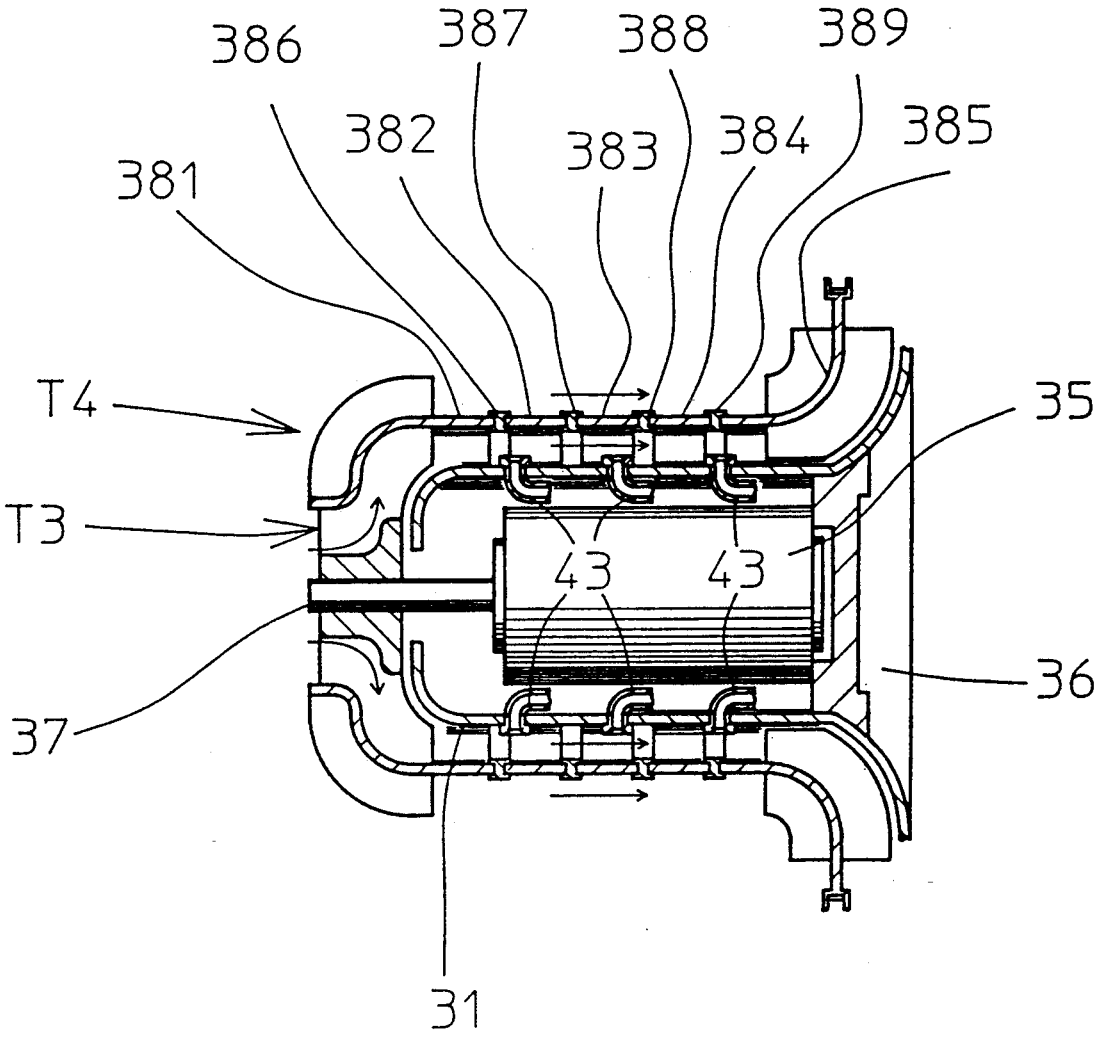
FIG. 7 is sectional view of the essential portion of a modified version of the heat exchanger of FIG. 5.

FIG. 7 shows the essential portion of a heat exchanger 30 that is a modification of the one shown in FIG. 5. In the arrangement of FIG. 7, the moving partition member 380 has a plurality of annular members 381 to 385 formed of thin aluminum sheet material interconnected by connecting rings 386 to 389 formed of heat insulating material. The moving partition member 380 thus has the same shape as the moving partition member 38 shown in FIG. 5 but is constituted differently.

The presence of the heat insulating connecting rings 386 to 389 between adjacent ones of the annular members 381 to 385 markedly lowers the thermal conductivity of the moving partition member 380 in the axial direction, thus increasing the heat gradient of a fluid passing in contact with its surface. What this means in specific terms is that the slopes of the curves M1 and M2 in FIG. 6 are increased. As a result, the indoor air W2 can be cooled more effectively.

Figure 8:
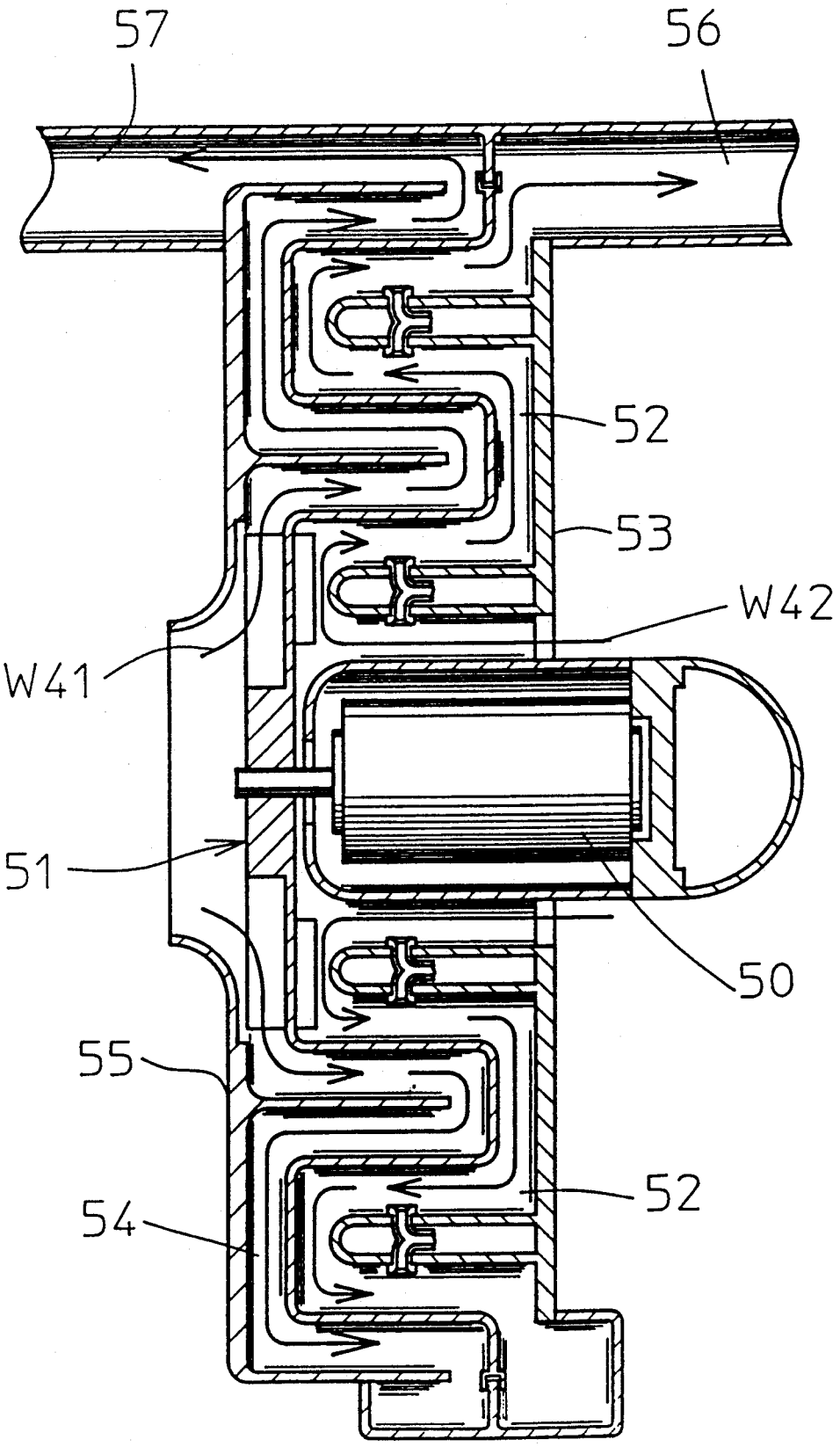
FIG. 8 is a sectional view of another embodiment of the heat exchanger according to the invention.

FIG. 8 shows another embodiment of the invention in which a moving partition member 51 rotated by a motor 50 is formed in a zigzag configuration, a first wall member 53 and a second wall member 55 are provided on opposite sides of the zigzagging moving partition member 51 for forming a humidification chamber 52 and a cooling chamber 54, and outdoor air W42 and indoor air W41 are passed through the weaving passages of the humidification chamber 52 and the cooling chamber 54 and discharged through associated ducts 56 and 57. The heat exchanger of FIG. 8 operates in the same manner as that of FIG. 5. The arrangement in FIG. 8 is advantageous, however, in that the branching of the ducts 56 and 57 to the left and right facilitates the installation of the ducts to the room and outdoor sides and thus enables a more compact overall arrangement, and that the centrifugal force constantly acting on the fluids W41 and W42 ensures a large force for passing these fluids.

What is claimed is:

1. A heat exchanger for exchanging heat between a first fluid and a second fluid, the heat exchanger comprising:

a moving partition member for heat transmission between the first fluid and the second fluid, a housing partitioned by the moving partition member into one chamber for passing the first fluid in a first direction and another chamber for passing the second fluid in a second direction substantially opposite from the first direction, and a power source for rotating the moving partition member, wherein at least the first fluid is compressible, further comprising means for adiabatically compressing the first fluid in the one chamber, wherein the compression means comprises an upstream centrifugal turbine provided at the upstream end of the one chamber for imparting a forward thrust of a prescribed magnitude to the first fluid for forcing it into the one chamber and a downstream centrifugal turbine provided at the downstream end of the one chamber for imparting a backward thrust of a prescribed magnitude smaller than the magnitude of the forward thrust to the first fluid for forcing it in the upstream direction.

2. A heat exchanger as claimed in claim 1, wherein the cylindrical moving partition member is formed of a material exhibiting high thermal conductivity.

3. A heat exchanger as claimed in claim 2, wherein the first and second fluids flow crosswise to the direction of rotation of the cylinder member.

4. A heat exchanger as claimed in claim 2, wherein at least one turbine is constituted by providing fins on the cylinder member surface facing the one chamber.

5. A heat exchanger as claimed in claim 1, further comprising centrifugal turbine for imparting thrust to the second fluid for assisting its flow into the other chamber.

6. A heat exchanger for exchanging heat between a first fluid and a second fluid, the heat exchanger comprising:

a moving partition member for heat transmission between the first fluid and the second fluid, a housing partitioned by the moving partition member into one chamber for passing the first fluid and another chamber for passing the second fluid, and a power source for rotating the moving partition member, wherein at least the first fluid is compressible, further comprising means for adiabatically compressing the first fluid in the one chamber, wherein the compression means comprises an upstream centrifugal turbine provided at the upstream end of the one chamber for imparting a forward thrust of a prescribed magnitude to the first fluid for forcing it into the one chamber and a downstream centrifugal turbine provided at the downstream end of the one chamber for imparting a backward thrust of a prescribed magnitude smaller than the magnitude of the forward thrust to the first fluid for forcing it in the upstream direction.

* * * * *